US010408199B2

(12) United States Patent
Drixler et al.

(10) Patent No.: US 10,408,199 B2
(45) Date of Patent: Sep. 10, 2019

(54) HYDROSTATIC AXIAL PISTON MACHINE OF SWASH PLATE DESIGN WITH AN ADJUSTABLE SWEPT VOLUME, IN PARTICULAR HYDROSTATIC AXIAL PISTON PUMP

(71) Applicant: Robert Bosch GmbH, Stuttgart (DE)

(72) Inventors: Daniel Drixler, Rottweil (DE); Erik Leipersberger, Horb am Neckar (DE)

(73) Assignee: Robert Bosch GmbH, Stuttgart (DE)

( * ) Notice: Subject to any disclaimer, the term of this patent is extended or adjusted under 35 U.S.C. 154(b) by 124 days.

(21) Appl. No.: 15/649,829

(22) Filed: Jul. 14, 2017

(65) Prior Publication Data

US 2018/0058433 A1 Mar. 1, 2018

(30) Foreign Application Priority Data

Aug. 25, 2016 (DE) ..... 10 2016 216 004

(51) Int. Cl.

| | |
|---|---|
| ***F04B 1/32*** | (2006.01) |
| ***F04B 1/20*** | (2006.01) |
| ***F01B 3/00*** | (2006.01) |
| *F03C 1/32* | (2006.01) |

(52) U.S. Cl.

CPC ..... *F04B 1/2085* (2013.01); *F01B 3/007* (2013.01); *F01B 3/0085* (2013.01); *F04B 1/2007* (2013.01); *F04B 1/2028* (2013.01); *F03C 1/0652* (2013.01)

(58) Field of Classification Search

CPC ..... F04B 1/324

See application file for complete search history.

(56) References Cited

U.S. PATENT DOCUMENTS

| | | | | |
|---|---|---|---|---|
| 4,175,914 A * | 11/1979 | Unruh | F04B 1/324 417/218 |
| 5,515,829 A * | 5/1996 | Wear | F02B 75/22 123/446 |
| 2014/0130661 A1* | 5/2014 | Howind | F04B 49/123 91/506 |

OTHER PUBLICATIONS

Bosch Rexroth AG; Axial piston variable pump A10V0 series 52 and 53; RE 92703, Edition 12.2015, Product Sheet, Horb a.N., Germany (68 pages).

* cited by examiner

*Primary Examiner* — F Daniel Lopez

(74) *Attorney, Agent, or Firm* — Maginot, Moore & Beck LLP

(57) ABSTRACT

A hydrostatic axial piston machine includes a housing, a cylinder barrel, and a drive shaft, which are connected together and mounted in the housing so as to rotate jointly about a first axis. The machine also includes a swash plate mounted in the housing so as to pivot about a second axis to adjust a swept volume of the machine. The machine further includes a hydraulic actuating apparatus, which has an actuating piston that delimits an actuating chamber. The machine also includes a regulating valve attached to a flange face of the housing. The regulating valve has connections situated in the flange face that are used to communicate hydraulic fluid to and from the actuating chamber. The flange face is arranged obliquely so as to enclose an angle with the second axis that is greater than 0° and smaller than 90°.

10 Claims, 8 Drawing Sheets

HYDROSTATIC AXIAL PISTON MACHINE OF SWASH PLATE DESIGN WITH AN ADJUSTABLE SWEPT VOLUME, IN PARTICULAR HYDROSTATIC AXIAL PISTON PUMP

This application claims priority under 35 U.S.C. § 119 to patent application no. DE 10 2016 216 004.4, filed on Aug. 25, 2016 in Germany, the disclosure of which is incorporated herein by reference in its entirety.

BACKGROUND

The disclosure relates to a hydrostatic axial piston machine of swash plate design with an adjustable swept volume, in particular a hydrostatic axial piston pump. The hydrostatic axial piston machine has a housing, a cylinder barrel and a drive shaft, which are connected to one another such that they cannot be twisted, and are mounted in the housing such that they can be rotated jointly about a first axis, a swash plate which is mounted in the housing such that it can be pivoted about a second axis in order to adjust the swept volume, a hydraulic actuating apparatus with an actuating piston which delimits an actuating chamber, is guided rectilinearly in an actuating chamber bore of the housing, and by way of which the swash plate can be pivoted, and a regulating valve which is attached to a flange face of the housing, which flange face is situated to the side of the actuating chamber bore. The regulating valve has a pressure connector which lies above a pressure opening of the housing which is situated in the flange face, a control connector which lies above a control opening of the housing which is situated in the flange face, and a tank connector which lies above a tank opening of the housing which is situated in the flange face, and via which regulating valve hydraulic fluid can be fed from the pressure connector via the control connector to the actuating chamber and can be displaced out of the actuating chamber via the control connector to the tank connector.

A hydrostatic axial piston pump having the above-specified features is known from the data sheet RE 92703 Edition 12.2015 from Bosch Rexroth AG. In the case of the known axial piston pump, the flange face for the attachment of the regulating valve, which flange face is configured on the housing, lies in a plane which runs parallel both to the rotational axis of the drive shaft and parallel to the pivoting axis of the swash plate. There are different variants for the attachment, which variants are configured depending on the desired regulation. For example, the regulating valve can operate as a pressure regulator, as an adjustable pressure regulator or as a pressure and delivery flow regulator. The connectors of the regulating valves are connected via bores in the housing to a pressure source, a pressure sink and to the actuating chamber, the bore system being complex and its production being associated with great outlay on account of the position of the flange face.

It is therefore an object of the disclosure to configure a hydrostatic axial piston machine such that the outlay for the attachment of the connectors of the regulating valve can be reduced.

SUMMARY

In the case of a hydrostatic axial piston machine having the features from the precharacterizing clause, said object is achieved by virtue of the fact that the attachment face, also referred to herein as a flange face, is arranged obliquely in such a way that a normal on a plane which lies in the flange face encloses an angle with the second axis, which angle is greater than 0° and less than 90°. In an arrangement of this type, a simple bore system is possible between the openings which are situated in the flange face and a pressure supply, to the interior of the housing which is connected to a tank, and to the control chamber bore. In comparison with the prior art, the simplification can be expressed in the fact that the number of required bores and, in conjunction with this, the number of bore intersections and the outlay for deburring them, and the number of outlet openings to be closed can be reduced and at least some bores can be shortened. A smaller number of outlet openings to be closed shortens the assembly time and leads to a saving of closure plugs.

The angle which is enclosed by the normal on the plane which lies in the flange face with the second axis, that is to say with the pivoting axis of the swash plate, preferably lies between 40° and 70°. In addition to a simple bore system of the housing, a compact overall design is also possible as a result, the regulating valve not protruding beyond the housing, or only protruding to a small extent, both in the direction of the second axis and perpendicularly with respect to a plane which is defined by the first axis and the second axis.

A bore advantageously leads from the control opening in the flange face of the housing directly into the actuating chamber bore of the housing. There is therefore only a single bore for connecting the control opening to the actuating chamber bore.

The housing of a hydrostatic axial piston machine is very often assembled from a pot-like main housing part, in which the swash plate is mounted, and a connector plate which lies on a free end face of the main housing part and in which a high pressure duct is situated for supplying hydraulic consumers such as hydraulic cylinders or hydraulic motors. The pressure opening of the housing is then preferably connected fluidically to the high pressure duct of the connector plate at least via a bore which emanates from the end face of the main housing part. Since a bore which emanates from the end face of the main housing part and leads directly to the pressure opening would open very obliquely into the flange face, it is favorable if a bore emanates from the pressure opening in the flange face, which bore meets the bore which emanates from the end face of the main housing part.

It is known, apart from the actuating piston, also a further regulating valve in the actuating chamber bore which is situated in the main housing part, for example a regulating valve for regulating the torque or a regulating valve for adjusting the swept volume of the axial piston machine in a signal-proportional manner, in particular in an electro-proportional manner. There is then a bore in the main housing part, which bore is connected fluidically to the bore which emanates from the end face of the main housing part, and which bore leads into the actuating chamber bore.

For space reasons, the regulating valve is advantageously not always attached on that side of a plane which lies perpendicularly on the second axis and in which the axis of the actuating chamber bore lies, on which side the high pressure section of the connector plate and therefore also the opening of the bore which emanates from the free end face of the main housing part are situated, but rather on the other side of said plane. A bore which intersects the control chamber bore in a manner which crosses the second plane, or leads past the control chamber bore on the outside then belongs to the fluid path which emanates from the free end face of the main housing part and leads to the pressure opening in the flange face. The first alternative comes into question, above all, when a further regulating valve which is to be connected to the high pressure duct is situated in the control chamber bore.

The actuating chamber bore can run obliquely with respect to the first axis.

A bore which emanates from the tank opening in the flange face preferably leads directly into the interior of the housing which is usually connected to the tank.

The pressure opening, the control opening and the tank opening are preferably situated in the flange face on one line parallel to the axis of the drive shaft.

BRIEF DESCRIPTION OF THE DRAWINGS

A plurality of exemplary embodiments, provided for use as axial piston pumps, of a hydrostatic axial piston machine according to the disclosure are shown in the drawings. The disclosure will then be described in greater detail using the figures of said drawings, in which.

DETAILED DESCRIPTION

Figure 1:
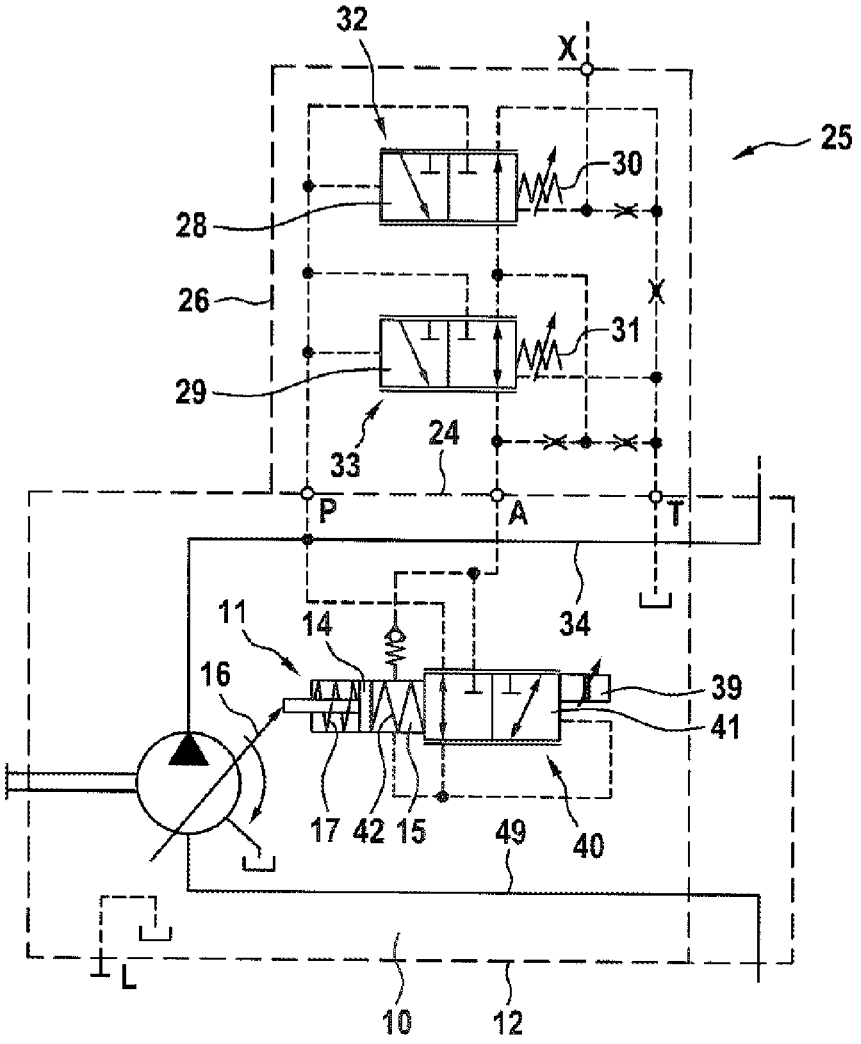
FIG. 1 shows a circuit diagram of an adjustable hydrostatic axial piston pump with a pressure regulation means, a delivery flow regulation means and an electro-proportional adjusting means.
Figure 2:
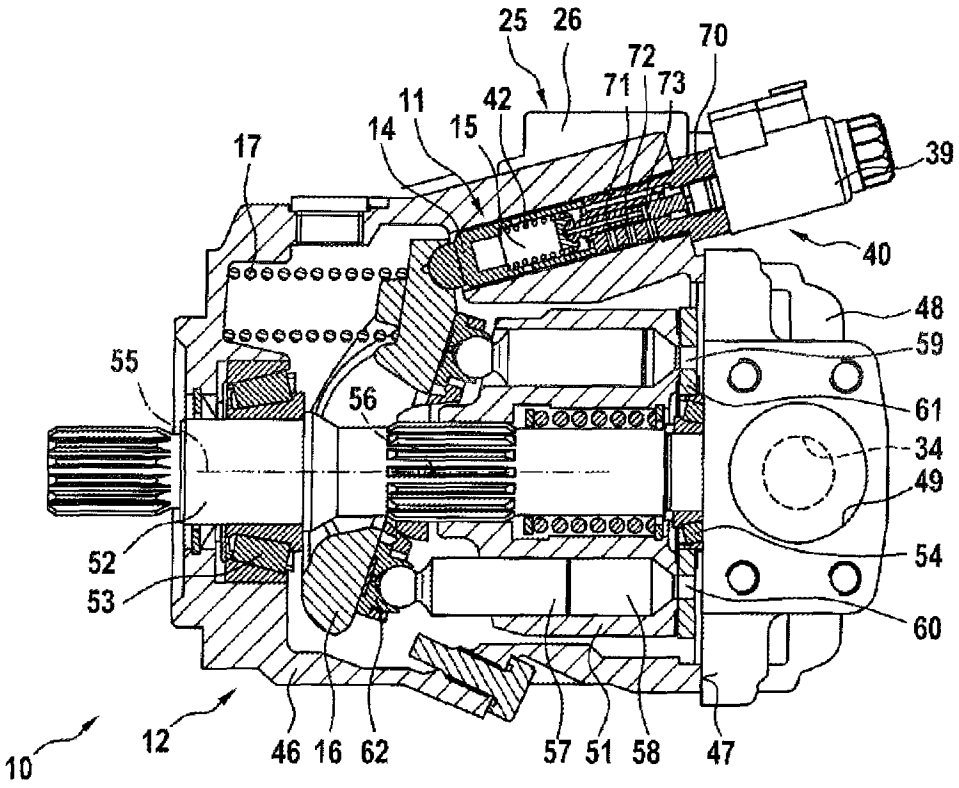
FIG. 2 shows a longitudinal section through a first exemplary embodiment, in which the circuit diagram according to FIG. 1 is realized.

The axial piston pump 10 which is shown in FIG. 1 by way of its circuit diagram and is shown in FIG. 2 in a longitudinal section has a delivery volume which can be adjusted with the aid of an adjusting apparatus 11 which comprises an actuating chamber bore 13 which is configured in a pump housing 12, and an actuating piston 14. The latter can be displaced rectilinearly in the actuating chamber bore 13 and delimits an actuating chamber 15, into which, in a manner controlled by the regulating valves, pressure medium can flow in and out of which pressure medium can be displaced via the regulating valves. Under the action of the pressure which prevails in the actuating chamber, the actuating piston 14 bears against the swash plate 16 (indicated in FIG. 1 only by way of an arrow) of the axial piston pump and attempts to adjust the swash plate 16 in the direction of a reduction of the delivery volume.

A counterspring 17 acts on the swash plate 16 in the opposite direction, which counterspring 17, unlike what is shown in the circuit diagram according to FIG. 1, does not act directly on the actuating piston, but rather, as can be seen from FIG. 2, acts on the swash plate 16. An action of the counterspring on the actuating piston would make a positively locking connection necessary between the actuating piston and the swash plate 16 in both adjusting directions.

A regulating valve 25 is attached to a flange face 24 of the pump housing 12, which regulating valve 25 is also casually called a pressure/delivery flow regulator and, in a common valve housing 26, has a regulating piston 28 for delivery flow regulation and a regulating piston 29 for regulating, more precisely for limiting the pump pressure. The regulating piston 28 is loaded by an adjustable regulating spring 30 and the regulating piston 29 is loaded by an adjustable regulating spring 31 in the direction of a rest position which is shown in FIG. 1. The two regulating pistons can be adjusted continuously out of the rest position. Together with the housing 26, each of them represents a proportionally adjustable 3/2-way valve which are to be called a delivery flow regulator 32 and a pressure regulator 33 in the following text.

In a mounting face, by way of which it lies on the flange face 24, the regulating valve 25 has a pressure connector P, a control connector A and a tank connector T which lie in a row one behind another. In addition, the regulating valve 25 has an external control connector X. The pressure connector P is connected to a high pressure duct 34 via a bore system within the pump housing 12. The tank connector is connected to the interior of the pump housing via a bore system within the pump housing 12 and is connected to a tank in a way which is not shown in greater detail via a leakage connector of the pump housing. The control connector A is connected to the actuating chamber bore 13 via a bore system in the pump housing. The regulating valve 25 can feed pressure medium via the control connector A from the pressure connector P to the actuating chamber 15 or can discharge pressure medium out of the actuating chamber to the tank connector T.

The delivery flow regulator 32 has a supply connector which is connected to the pressure connector P via a supply duct which runs in the valve housing 26. A supply connector of the pressure regulator 33 is likewise connected to the supply connector p. A tank connector of the delivery flow regulator 32 is connected to the tank connector T via a relief line which runs in the valve housing 26. A control connector of the delivery flow regulator 32 is connected to a neutral connector of the pressure regulator 33. Finally, a control connector of the pressure regulator is connected to the control connector A of the regulating valve 25.

Apart from the regulating spring 30, the regulating piston 28 of the delivery flow regulator 32 is loaded via the pressure connector P with pump pressure and via the external control connector X with a control pressure which is, for example, the highest load pressure of those hydraulic consumers which are supplied with hydraulic fluid at the same time by the axial piston pump. Here, the control pressure acts in the same direction as the regulating spring 30, whereas the pump pressure acts counter to the regulating spring and the control pressure. Therefore, the delivery flow regulator is capable of adjusting a pump pressure which lies above the control pressure by the pressure equivalent of the regulating spring 30, for example by 20 bar.

The regulating piston 29 of the pressure regulator is loaded by the pump pressure counter to the regulating spring 31.

In the rest position of the pressure regulator 33, its control connector and therefore the control connector A is connected to the neutral connector and, furthermore, via the control connector of the delivery flow regulator 32 to the tank connector T, with the result that pressure medium can be displaced out of the actuating chamber 15 by way of the counterspring 17. The delivery volume of the pump is increased as a result. If the regulating piston 28 of the delivery flow regulator is then displaced far enough out of its rest position, the control connector A is connected to the pressure connector P, and pressure medium can flow to the actuating chamber 15. As a result, the actuating piston 14 is displaced and pivots the swash plate 16 toward smaller pivoting angles counter to the force of the counterspring 17 and possibly additional drive unit forces, with the result that the delivery volume is reduced. If the pump pressure become so high that it exceeds the pressure equivalent of the regulating spring 31, the regulating piston 29 of the pressure regulator 33 is moved out of its rest position, with the result that pressure medium can be fed directly via the pressure regulator to the actuating chamber 15 from the pressure connector P and the delivery volume of the pump is reduced.

From the control connector A of the regulating valve 25, the fluid path does not lead directly into the actuating chamber 15. Rather, a regulating valve 40 which can be actuated proportionally by way of an electro-proportional magnet 39 is also inserted into said fluid path, which regulating valve 40 is configured as an installation cartridge, is inserted into the actuating chamber bore 13, and delimits the actuating chamber 15 on the side which faces away from the actuating piston 14. The regulating valve 40 (also casually called an EP regulator), the structural configuration of which can be seen in greater detail from FIG. 2, has a pressure connector which is connected directly to the bore system between the pressure connector P of the regulating valve 25 and the high pressure duct 34, a neutral connector which is connected to the control connector A of the regulating valve 25, and an actuating chamber connector which is connected to the actuating chamber 15. A regulating piston 41 of the regulating valve 40 is loaded in the direction of a rest position by the force of a feedback spring 42 which is clamped in between the regulating piston 41 and the actuating piston 14, in which rest position the actuating chamber connector is connected to the pressure connector of the regulating valve 40. Here, the force of the feedback spring is dependent on the position of the actuating piston and therefore on the position of the swash plate 16. The proportional magnet 39 is capable of displacing the regulating piston 41 counter to the feedback spring 42 into positions, in which the actuating chamber connector is connected to the neutral connector and, furthermore, via the control connector A of the regulating valve 25 to the pressure connector P or to the tank connector T of said regulating valve 25. The regulating piston 41 is pressure-equalized with respect to the pressure which prevails in the actuating chamber 15. The pressure which prevails in the actuating chamber therefore does not exert any resulting force on the regulating piston 41. The regulating piston 41 assumes a regulating position when the force which is exerted by the feedback spring 42 is just as great as the force of the proportional magnet. Since the force which is exerted by the feedback spring 42 is dependent on the position of the swash plate 16, a defined pivoting angle of the swash plate 16 is therefore adjusted in a manner which is proportional to the current which flows through the proportional magnet. An electro-proportional adjusting means of the pump is therefore realized by way of the regulating valve 40. Said regulation means only takes effect, however, when the current through the proportional magnet generates a magnetic force which equal to or smaller than the one value equal to a value The electro-proportional regulation of the pivoting angle by way of the regulating valve 40 always has precedence over the regulation by way of the delivery flow regulator 32 when the current which is set at the proportional magnet 39 corresponds to a pivoting angle of the swash plate 16, which pivoting angle is smaller than the pivoting angle which the delivery flow regulator 32 aims to set.

The structural design of the axial piston pump can be seen in greater detail from FIG. 2. The pump housing 12 can be seen. The latter comprises a pot-like main housing part 46 with a free end face 47, and a connector plate 48, in which a suction duct 49 which ends on the outside in a suction opening and the high pressure duct 34 which ends on the outside in a high pressure opening are configured. The suction duct 49 and the high pressure duct 34 open toward the inner side of the connector plate 48 in a kidney-shaped manner. The connector plate 48 lies on the free end face 47 of the main housing part 46 and is screwed to the latter. A drive unit is accommodated in the pump housing 12, to which drive unit a cylinder barrel 51, a drive shaft 52 which is mounted in the pump housing via two tapered roller bearings 53 and 54 such that it can be rotated about a rotational axis 55, and to which drive shaft 52 the cylinder barrel 51 is coupled such that it cannot be twisted, and the abovementioned swash plate 16 which can be pivoted about a pivoting axis 56, which runs perpendicularly with respect to the rotational axis 55 of the drive shaft, and therefore can be adjusted in its angular position with respect to the rotational axis 55 of the driveshaft. A multiplicity of displacing pistons 57 which in each case delimit a working space 58 are guided in the cylinder barrel 51 parallel to the axis of the drive shaft 52. The pressure medium feed and the pressure medium discharge to/from the working spaces 58 are controlled via two control kidneys 59 and 60 which are configured in a control plate 61 which is held in a rotationally fixed manner with respect to the housing, and of which one is open to the suction duct and the other is open to the high pressure duct in the connector plate 48. The control kidneys 59 and 60 cannot be seen per se in the section according to FIG. 2 because they lie in front of and behind the plane of the drawing, but are marked for the sake of clarity.

Those heads of the displacer pistons 57 which face away from the working spaces 58 are supported via sliding pads 62 on the swash plate 16, the pivoting angle of which can be adjusted by means of the adjusting apparatus 11 in order to change the swept volume. In the exemplary embodiment which is shown, the swash plate 16 is prestressed into a basic position via the counterspring 17 which acts counter to the force which is exerted on the swash plate by the actuating piston 14, in which basic position the pivoting angle and therefore the swept volume of the axial piston pump are at a maximum.

The actuating chamber bore 13, in which the actuating piston 14 is guided directly and into which the regulating valve 14 for the electro-proportional regulation means is inserted, is configured on the main housing part 46 and has a longitudinal axis, the longitudinal axis of which lies in a plane which passes through the rotational axis 55 of the driveshaft and lies perpendicularly on the pivoting axis 56 of the swash plate. Moreover, the longitudinal axis of the actuating chamber bore 13 runs at an angle of greater than zero with respect to the rotational axis 55, that is to say obliquely with respect to the latter.

The EP regulator 40 is screwed into the actuating chamber bore 13 with a cartridge-like valve housing 70. The regulating piston 41 is guided displaceably in a central longitudinal bore of the valve housing 70. Three annular grooves 71, 72 and 73 run around the valve housing 70 on the outside so as to lie axially behind one another, which annular grooves 71, 72 and 73 are sealed from one another and from the actuating chamber 15 and toward the outside by way of sealing rings. From the annular groove 71 which represents the pressure connector of the EP regulator, one or more radial bores lead inward into the central longitudinal bore. From the annular groove 72, one or more radial bores likewise lead inward into the central longitudinal bore, one or more of said radial bores being connected to the actuating chamber 15 via axial bores (not shown in greater detail in FIG. 2) which run in the valve housing 70. Unlike what is shown in FIG. 2, the radial bores which emanate from the annular groove 72 are therefore offset in terms of the angle with respect to the radial bores which emanate from the annular groove 71. The annular groove 72 can be considered to be an actuating chamber connector of the EP regulator. Finally, from the annular groove 73, one or more radial bores also lead inward into the central longitudinal bore. The annular groove 73 represents the neutral connector of the EP regulator.

By way of extension of the bush-like actuating piston 14 of the adjusting apparatus 11, the swash plate can be pivoted back counter to the force of the counterspring 17 and counter to the drive unit forces in order to reduce the pivoting angle and therefore the swept volume as far as into a position of minimum swept volume, for example as far as the swept volume zero. The attachment of the actuating piston 14 to the swash plate 16 takes place as shown, for example, via a ball 59 which is inserted movably into the swash plate and has a flattened portion, against which the actuating piston 14 bears with the flat outer bottom side. FIG. 2 shows the pivot cradle in a position which corresponds to a maximum swept volume.

According to the disclosure, the flange face 24 which is configured on the main housing part 46 is now arranged obliquely for the attachment of the regulating valve 25, in such a way that a normal on a plane which lies in the flange face 24 encloses an angle with the pivoting axis 56 of the swash plate 16, which angle is greater than 0° and is smaller than 90°.

Figure 3:
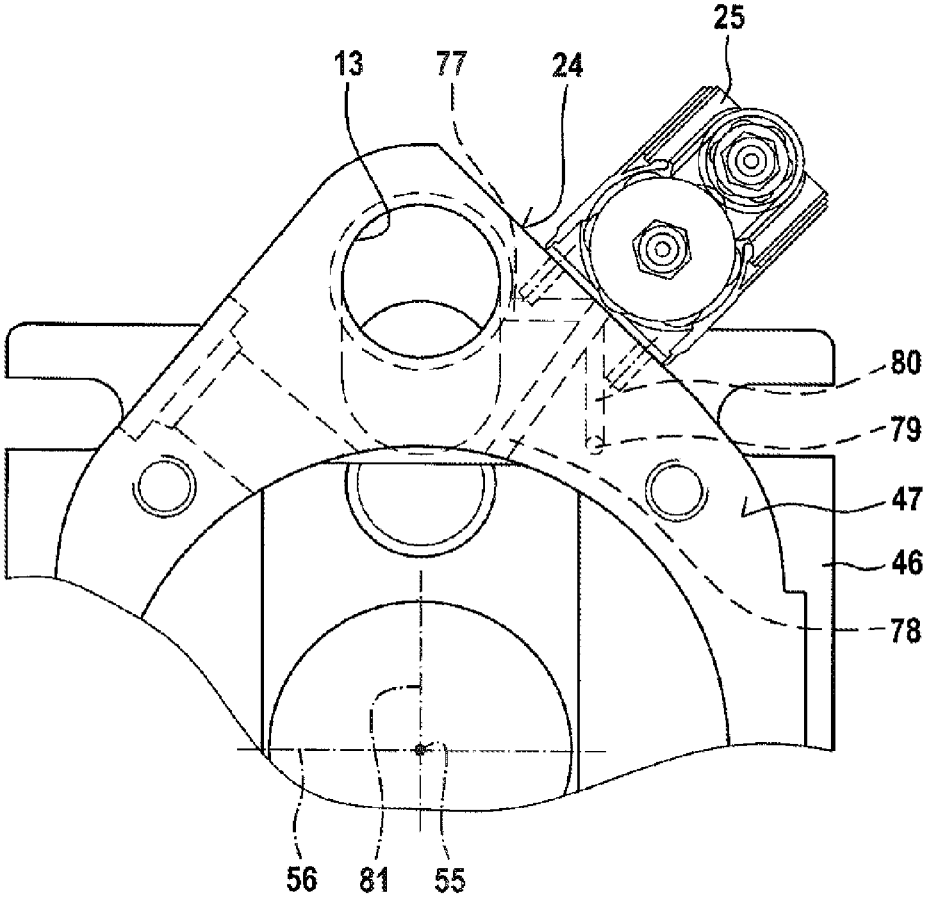
FIG. 3 shows a view of the main housing part of a further exemplary embodiment in the axial direction with a pressure/delivery flow regulator which is mounted on the main housing part on the one side of a central plane of said main housing part.
Figure 4:
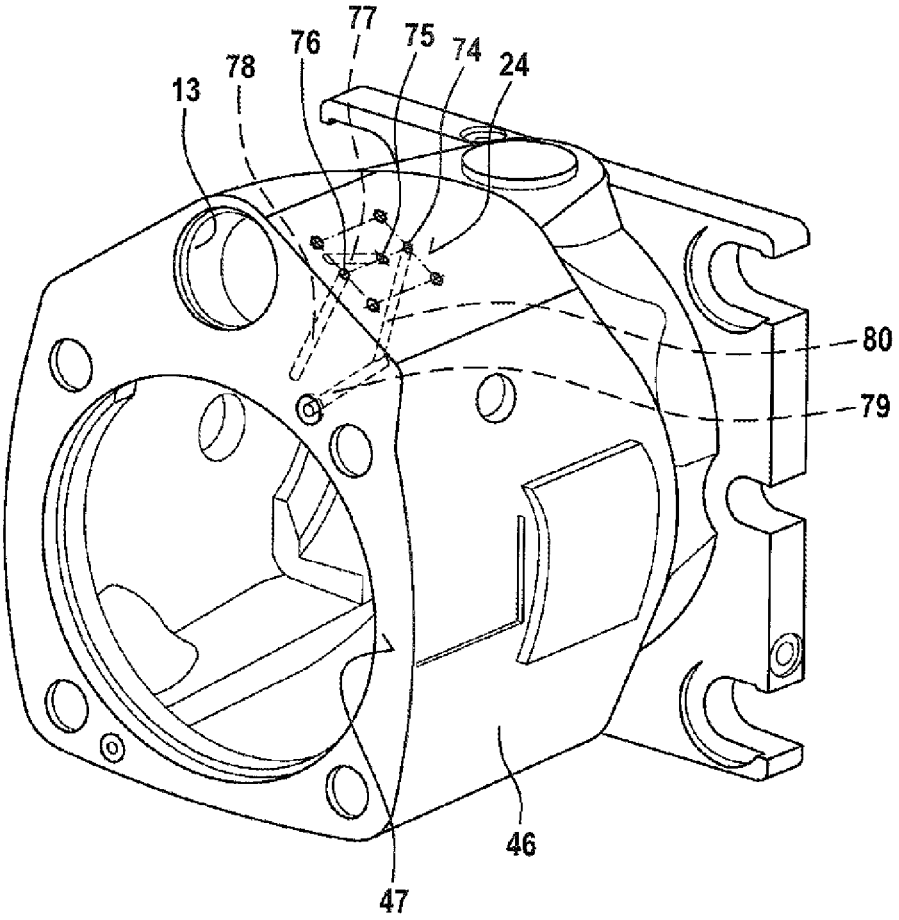
FIG. 4 shows a perspective view of the main housing part from FIG. 3 without the pressure/delivery flow regulator.

In the exemplary embodiment according to FIGS. 3 and 4, the angle between the normal onto the flange face 24 and the pivoting axis 56 of the swash plate 16 is 45°, as is clearly apparent from FIG. 3. There is also the same angle between a normal onto the flange face 24 and the pivoting axis 56 of the swash plate 16 in the exemplary embodiment according to FIG. 2.

As shown using the circuit diagram according to FIG. 1, the regulating valve 25 has a pressure connector P which is connected to the high-pressure duct 34, a tank connector which is connected to the interior of the pump housing 12, and a control connector A which, according to FIG. 1, is connected to the regulating valve 40, from which, however, a fluid path leads directly to the actuating chamber 15 if there is not a further regulating valve which is inserted into the actuating chamber bore, but rather the actuating chamber bore 13 is closed by way of a plug. FIGS. 3 and 4 show an embodiment of this type without a further regulating valve.

In accordance with the connectors of the regulating valve which lie in a row behind one another in the attachment face of the regulating valve 25, a pressure opening 74, a control opening 75 and a tank opening 76 are arranged axially behind one another in a row in the flange face 14 of the main housing part 46, the axial direction being defined by the direction of the rotational axis 55 of the drive shaft 52. The tank opening 76 is at the smallest spacing, and the pressure opening 74 is at the greatest spacing from the end face 47 of the main housing part 46, and the control opening 75 is situated between the two other openings. From the control opening, a bore 77 which runs parallel to the pivoting axis 56 of the swash plate and therefore obliquely with respect to the flange face 14 then leads directly into the actuating chamber bore 13. Via said bore 77, the actuating chamber 15 is connected to the control connector of the regulating valve 25. A further bore 78 leads from the tank opening 76 directly into the interior of the main housing part 46 and therefore into the interior of the pump housing 12. The bore 78 also runs slightly obliquely with respect to the flange face 14. Otherwise, the bore 78 lies in a plane which lies perpendicularly on the rotational axis 55. Two bores 79 and 80 are provided in the main housing part 46 for the fluidic connection of the pressure opening 74 to the high pressure duct 34 in the connector plate 48. The bore 79 emanates from the free end face 47 of the main housing part 46 and extends a defined distance into the main housing part in an approximately axial direction. The bore 80 emanates from the pressure opening 74, runs obliquely with respect to the flange face 24, and meets the bore 79. As can be seen clearly from FIG. 3, the two bores 79 and 80 define a plane which lies perpendicularly on the pivoting axis 56. Therefore, only four bores and an intersection of two bores in the main housing part 46 are necessary for the attachment of the regulating valve 25 to the fluidic surroundings.

The bore 79 which opens towards the end face 47 is continued in the connector plate 48 by way of a further bore (not shown in greater detail) which opens into the high pressure duct 34, with the result that overall there is one fluid path from the high pressure duct 34 to the pressure opening 74.

On account of the oblique course of the bores 77, 78 and 80, the openings 74, 75 and 76 in the flange face do not have a circular shape, but rather an elliptical shape. They are nevertheless still surrounded by the sealing rings which are present in the attaching face of the regulating valve and surround the connectors on the regulating valve, with the result that the transition from an opening in the main housing part to a connector of the regulating valve is sealed towards the outside. The use of a flat seal which can be readily manufactured in accordance with the conditions also appears particularly advantageous here.

Figure 5:
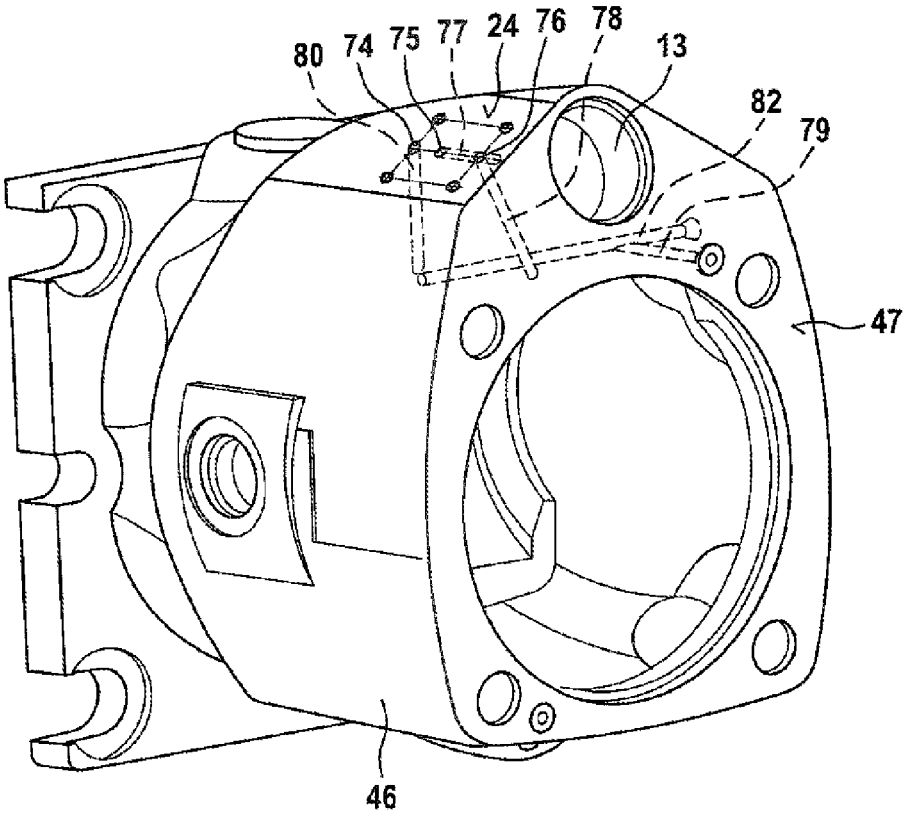
FIG. 5 shows a perspective view of the main housing part of a further exemplary embodiment with a flange face for a pressure/delivery flow regulator, which flange face is provided on the other side of a central plane of the main housing part in comparison with FIGS. 3 and 4.

In the exemplary embodiment according to FIGS. 3 and 4, the flange face 24 of the main housing part and therefore also the regulating valve 25 are situated on the side of a central plane 81 which passes through the drive shaft, lies perpendicularly on the pivoting axis 56, and on which the high pressure duct 34 of the connector plate and the opening of the bore 79 in the end face 47 are also situated. For space reasons, it can be advantageous if the regulating valve 25 is situated on the other side of said central plane 81. A flange face 24 is then configured at the corresponding point of the main housing part, as indicated in FIG. 5 which shows one exemplary embodiment with an arrangement of this type of the regulating valve 25. The bores 77 and 78 of said exemplary embodiment run in a mirror-symmetrical manner with regard to the central plane 81 with respect to the bores 77 and 78 from FIGS. 3 and 4. Apart from the bore 79 which emanates from the free end face 47 and is situated on the one side of the central plane 81 and the bore 80 which emanates from the pressure opening 74 and is situated on the other side of the central plane 81, a further bore 82 is then provided for the attachment of the pressure opening 74 to the high pressure duct 74, which further bore 82 is made in the main housing part 46 from one side of the latter, runs parallel to the pivoting axis 56 in the material between the actuating chamber bore 13 and the housing interior, and intersects the two bores 79 and 80. The bore 82 is closed toward the outside by way of a plug.

Figure 6:
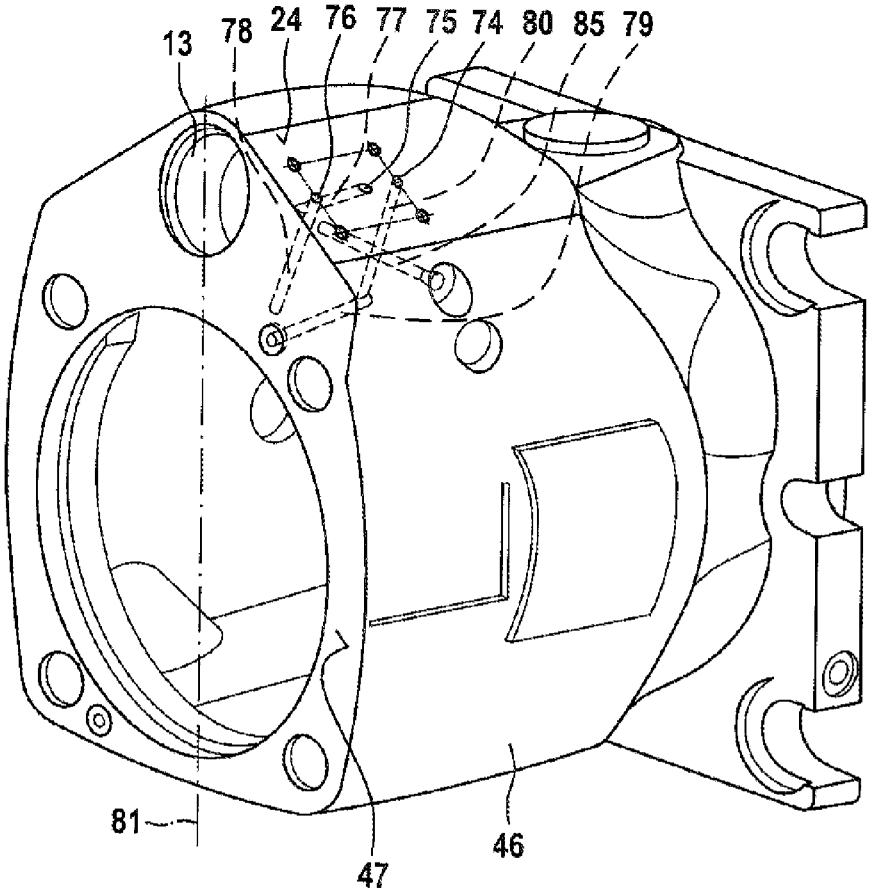
FIG. 6 shows a perspective view of the main housing part of a further exemplary embodiment with a flange face for a pressure/delivery flow regulator, which flange face is provided on the same side of a central plane of the main housing part as in FIGS. 3 and 4, and with a bore system for a further regulating valve.
Figure 7:
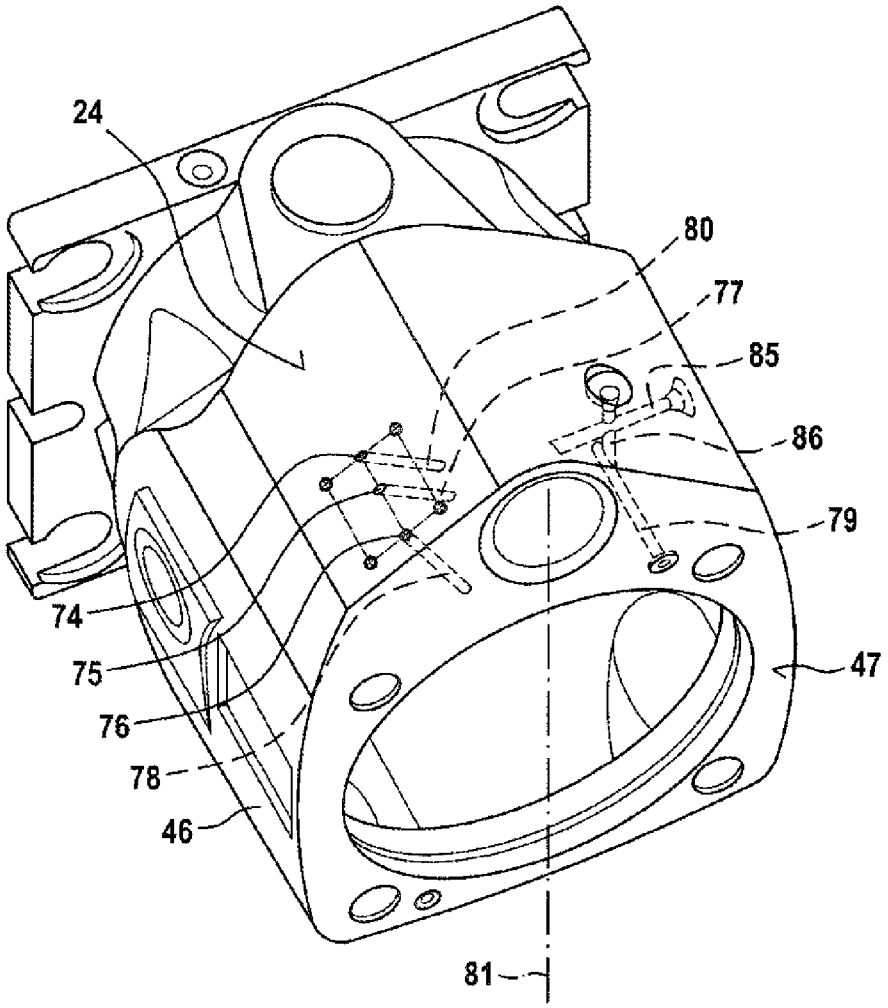
FIG. 7 shows a perspective view of the main housing part of a further exemplary embodiment with a flange face for a pressure/delivery flow regulator, which flange face is provided on the other side of a central plane of the main housing part in comparison with FIGS. 3 and 4, and with a bore system for a further regulating valve.

FIGS. 6 and 7 show the bore system in the main housing part 46 for two exemplary embodiments which, in accordance with FIGS. 1 and 2, in each case have a further regulating valve which is inserted into the actuating chamber bore 13. The further regulating valve can be provided, for example, for an electro-proportional regulation means or for a torque regulation means which is often also somewhat imprecisely called a power regulation means. It is to be assumed in the present case that an EP regulating valve 40 is inserted into the actuating chamber bore 13 of the main housing parts 46 of an axial piston pump which are shown in FIGS. 6 and 7, as shown in a circuit diagram in FIG. 1 and in a section in FIG. 2.

In the exemplary embodiment according to FIG. 6, the flange face 24 for the attachment of a regulating valve 25 is situated on the first side of the central plane 81, as in the exemplary embodiment according to FIGS. 3 and 4, on which first side the high pressure duct 34 of the connector plate and the opening of the bore 79 in the end face 47 are also situated. With regard to said bore 79 and with regard to the bores 77, 78 and 80 and therefore also with regard to the openings 74, 75 and 76, the main housing part 46 according to FIG. 6 is of substantially identical configuration to the main housing part 46 from FIGS. 3 and 4, apart from possible small deviations in the directions of the bores. In contrast to the main housing part 46 from FIGS. 3 and 4, a further bore 85 is into the main housing part 46 from FIG. 6, which further bore 85 intersects the bore 80 and opens into the actuating chamber bore 13 at a point which is such that it is open toward the annular groove 71 after the insertion of the regulating valve 40. As the regulating valve 40 is connected to the high pressure duct 34 in the connector plate 48 via the bore 85 and via the bores 80 and 79. The bore 77 opens into the actuating chamber bore 13 at a point which is such that it is open toward the annular groove 73 of the valve housing 70. The neutral connector of the regulating valve 40 is therefore connected via the bore 77 to the control connector A of the regulating valve 25. The bore 85 is closed by way of a plug at the end which is remote from the actuating chamber bore 13.

In the exemplary embodiment according to FIG. 7, the flange face 24 for the attachment of a regulating valve 25 is situated, as in the exemplary embodiment according to FIG. 5, on the other (in comparison to the exemplary embodiments according to FIGS. 3, 4 and 6), second side of the central plane 81. With regard to the bores 77, 78, 79 and 80 and therefore also with regard to the openings 74, 75 and 76, the main housing part 46 according to FIG. 7 is of substantially identical configuration to the main housing part 46 from FIG. 5 apart from possible small deviations in the directions of the bores. In contrast to the main housing part 46 from FIG. 5, there are two bores 85 and 86 in the main housing part 46 from FIG. 7 on the first side of the central plane 81, as in the exemplary embodiment according to FIG. 6, the bore 86 running like the bore 80 of the exemplary embodiment according to FIG. 6, but being closed toward the outside by way of a plug in contrast to the bore 80 from FIG. 6. The bore 85 once again opens into the actuating chamber bore 13 at a point which is such that it is open toward the annular groove 71 after the insertion of the EP regulating valve 40. The regulating valve 40 is therefore connected to the high pressure duct 34 in the connector plate 48 via the bore 85 and via the bores 86 and 79. In contrast to the exemplary embodiment according to FIG. 5, the bore 80 leads from the opening 74 into the actuating chamber bore 13 in the exemplary embodiment according to FIG. 7. The opening is situated at a point of the actuating chamber bore 13 which is such that the bore 80, like the bore 85, is open toward the annular groove 71. Therefore, the opening 74 is connected to the high pressure duct in the connector plate via the bore 80, via the annular groove 71 and via the bores 85, 86 and 79.

Figure 8:
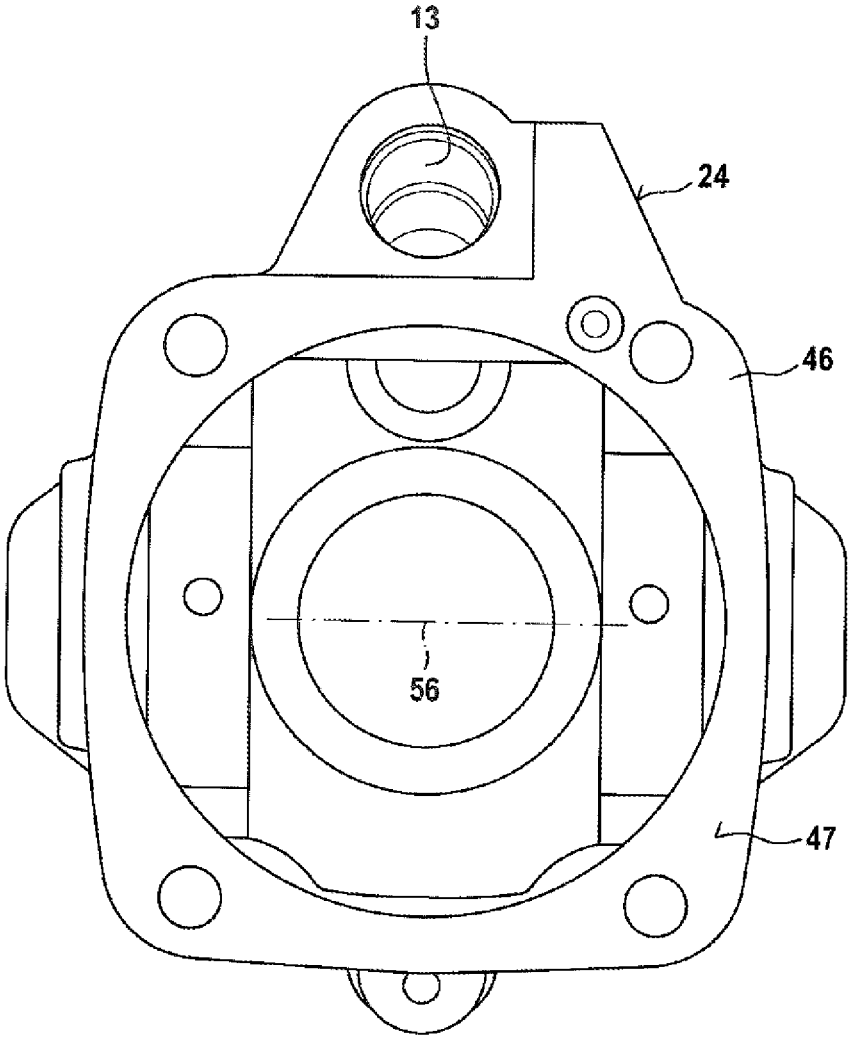
FIG. 8 shows an axial view of the main housing part of a further exemplary embodiment with a different angle than the previous exemplary embodiments between a normal onto the flange face and the pivoting axis of the swash plate.

In the exemplary embodiments of an axial piston pump according to the disclosure which are shown in FIGS. 2 to 7, the angle between a normal onto the flange face 24 and the pivoting axis 56 of the swash plate 16 is approximately 45°. In the further exemplary embodiment according to FIG. 8, an angle of approximately 65° is selected between a normal onto the flange face 24 on a main housing part 46 of an axial piston pump and the pivoting axis 56 of a swash plate. The bore system for connecting a regulating valve 25 and a regulating valve 40 can be designed as in the exemplary embodiments according to FIG. 3, 4 or 6.

LIST OF REFERENCE NUMERALS

10 Axial piston pump
11 Adjusting apparatus of 10
12 Pump housing
13 Actuating chamber bore
14 Actuating piston
15 Actuating chamber
16 Swash plate
17 Counterspring
24 Flange face
25 Regulating valve
26 Valve housing of 25
28 Regulating piston
29 Regulating piston
30 Regulating spring
31 Regulating spring
32 Delivery flow regulator
33 Pressure regulator
34 High pressure duct
39 Electro-proportional magnet
40 Regulating valve
41 Regulating piston
42 Feedback spring
46 Main housing part of 12
47 Free end face of 46
48 Connector plate
49 Suction duct
50 High pressure duct
51 Cylinder barrel
52 Drive shaft
53 Tapered roller bearing
54 Tapered roller bearing
55 Rotational axis of 52
56 Pivoting axis of 16
57 Displacer piston

58 Working space behind 55
59 Control kidney
60 Control kidney
61 Control plate
62 Sliding pad
70 Valve housing
71 Annular groove
72 Annular groove
73 Annular groove
74 Pressure opening
75 Control opening
76 Tank opening
77 Bore
78 Bore
79 Bore
80 Bore
81 Central plane
82 Bore
85 Bore
86 Bore
P Pressure connector
A Control connector
T Tank connector

What is claimed is:

1. A hydrostatic axial piston machine of swash plate design, comprising:

a housing;

a cylinder barrel;

a drive shaft connected to the cylinder barrel in such a way that the drive shaft and the cylinder barrel are rotationally fixed relative to one another, the drive shaft and cylinder barrel mounted in the housing so as to rotate jointly about a first axis;

a swash plate mounted in the housing so as to be pivoted about a second axis in order to adjust a swept volume of the hydrostatic axial piston machine;

a hydraulic actuating apparatus with an actuating piston that delimits an actuating chamber, the actuating piston is guided rectilinearly in an actuating chamber bore of the housing, and wherein the swash plate is configured to be pivoted by the actuating piston; and a regulating valve that is attached to a attachment face of the housing, the attachment face being arranged at a side of the actuating chamber bore, the regulating valve comprising:

a pressure connector which lies above a pressure opening of the housing which is arranged in the attachment face, a control connector which lies above a control opening of the housing which is arranged in the attachment face, and a tank connector which lies above a tank opening of the housing which is arranged in the attachment face, wherein, via the regulating valve, hydraulic fluid is (i) fed from the pressure connector via the control connector to the actuating chamber and (ii) displaced out of the actuating chamber via the control connector to the tank connector, wherein the attachment face is arranged obliquely such that a normal of a plane in which the attachment face lies defines an angle relative to the second axis that is greater than 0° and smaller than 90°, wherein the housing has a pot-like main housing part and a connector plate, the swash plate being mounted in the main housing part and the connector plate lying on a free end face of the main housing part, wherein a high pressure duct is arranged in the connector plate, and wherein the pressure opening of the housing is connected fluidically to the high pressure duct in the connector plate at least via a first bore which emanates from the end face of the main housing part.

2. The hydrostatic axial piston machine according to claim 1, wherein the angle between the normal and the second axis lies between 40° and 70°.

3. The hydrostatic axial piston machine according to claim 2, wherein the angle between the normal and the second axis lies between 45° and 65°.

4. The hydrostatic axial piston machine according to claim 1, further comprising a bore leading from the control opening in the attachment face of the housing directly into the actuating chamber bore of the housing.

5. The hydrostatic axial piston machine according to claim 1, further comprising a second bore emanating from the pressure opening in the attachment face, wherein the second bore meets the first bore that emanates from the end face of the main housing part.

6. The hydrostatic axial piston machine according claim 1, wherein the actuating chamber bore is arranged in the main housing part, and wherein a third bore in the main housing part (i) is connected to the first bore which emanates from the end face of the main housing part and (ii) leads into the actuating chamber bore.

7. The hydrostatic axial piston machine according to claim 1, wherein:

the actuating chamber bore is arranged in the main housing part and the axis of the actuating chamber bore lies in a second plane that lies perpendicularly on the second axis, the first bore which emanates from the end face of the main housing part and is connected fluidically to the high pressure duct of the connector plate is arranged on one side of the second plane and the attachment face is arranged on the other side of the second plane, and a fourth bore which leads past the actuating chamber bore on the outside such that the fourth bore crosses the second plane or opens into the actuating chamber bore belongs to the fluid path which emanates from the free end face of the main housing part and leads to the pressure opening in the attachment face.

8. The hydrostatic axial piston machine according to claim 1, wherein the actuating chamber bore runs obliquely with respect to the first axis.

9. The hydrostatic axial piston machine according to claim 1, wherein a bore which emanates from the tank opening in the attachment face leads directly into the interior of the housing.

10. The hydrostatic axial piston machine according to claim 1, wherein the hydrostatic axial piston machine is configured as a hydrostatic axial piston pump.

* * * * *